United States Patent [19]

Matuszak

[11] Patent Number: 5,069,355

[45] Date of Patent: Dec. 3, 1991

[54] EASY-OPENING COMPOSITE CLOSURE FOR HERMETIC SEALING OF A PACKAGING CONTAINER BY DOUBLE SEAMING

[75] Inventor: John J. Matuszak, Hartsville, S.C.

[73] Assignee: Sonoco Products Company, Hartsville, S.C.

[21] Appl. No.: 644,889

[22] Filed: Jan. 23, 1991

[51] Int. Cl.[5] ..... B65D 17/34

[52] U.S. Cl. ..... 220/270; 220/276; 220/359

[58] Field of Search ..... 220/254, 270, 276, 359; 215/232

[56] References Cited

U.S. PATENT DOCUMENTS

| | | | |
|---|---|---|---|
| 2,122,537 | 7/1938 | Pfeffer, Jr. . | |
| 2,858,060 | 10/1958 | Kuchler . | |
| 3,108,708 | 10/1963 | Betner . | |
| 3,256,981 | 6/1966 | Kurtz . | |
| 3,276,616 | 10/1966 | Lurie . | |
| 3,318,477 | 5/1967 | Southwick, Jr. et al. . | |
| 3,335,939 | 8/1967 | Robinson, Jr. . | |
| 3,402,873 | 9/1968 | Lauterbach, Jr. . | |
| 3,483,964 | 12/1969 | Muehling et al. . | |
| 3,515,334 | 6/1970 | Jacobson . | |
| 3,572,579 | 3/1971 | Mueller et al. . | |
| 3,832,963 | 9/1974 | Gayner et al. | 413/18 X |
| 3,868,919 | 3/1975 | Schrecker et al. | 413/18 X |
| 3,997,677 | 12/1976 | Hirsch et al. | 426/113 |
| 4,045,860 | 9/1977 | Winckler | 413/4 X |
| 4,091,930 | 5/1978 | Buchner et al. | 220/276 X |
| 4,207,989 | 6/1980 | Ingemann | 220/266 |
| 4,280,653 | 7/1981 | Elias | 220/359 X |
| 4,350,263 | 9/1982 | Hoffman | 220/359 |
| 4,351,473 | 9/1982 | Manizza . | |
| 4,359,852 | 11/1982 | Hoffman et al. | 53/420 |
| 4,363,582 | 12/1982 | Bloeck et al. | 413/12 |
| 4,433,793 | 2/1984 | Ingemann | 220/276 |
| 4,448,324 | 5/1984 | Jeppsson et al. | 220/266 |
| 4,529,100 | 7/1985 | Ingemann | 220/359 |

(List continued on next page.)

FOREIGN PATENT DOCUMENTS

| | | |
|---|---|---|
| 0001250 | 4/1979 | European Pat. Off. . |
| 0312302 | 4/1989 | European Pat. Off. . |
| 0312311 | 4/1989 | European Pat. Off. . |
| 2001032 | 7/1970 | Fed. Rep. of Germany . |
| 3148742 | 4/1977 | Japan . |
| 5599838 | 12/1978 | Japan . |
| 6138075 | 3/1980 | Japan . |
| 0138267 | 4/1985 | Japan . |

*Primary Examiner*—Stephen Marcus
*Assistant Examiner*—Nova Stucker
*Attorney, Agent, or Firm*—Bell, Seltzer, Park & Gibson

[57] ABSTRACT

An easy-opening closure is provided for hermetic sealing of the open end of a packaging container. The closure includes a composite end for being double-seamed to the container and having an interior ledge portion defining a central opening through the closure. The composite end includes at least two polymer layers defining a predetermined peel strength for delamination and a formable substrate layer bonded to the bottom one of the polymer layers and adapting the end member to be double-seamed to the container. The end member has a notch cut into the top polymer layer in the ledge portion which is spaced from and surrounds the central opening. A lidding member covers the central opening and has a portion overlapping and bonded to the top polymer layer in the ledge portion of the end member to define a predetermined bond strength greater than the peel strength of the two polymer layers of the end member. With this construction, the force required to open the closure from the inside of the container is greater than the force required to open the closure from the outside of the container since the closure is easily-opened by upward pulling of the bonded overlapping portions of the lidding member to cause delamination and peeling of the portion of the top polymer layer bonded to the lidding member from the bottom polymer layer beginning at the notch and continuing to the central opening.

11 Claims, 2 Drawing Sheets

U.S. PATENT DOCUMENTS

| | | | |
|---|---|---|---|
| 4,533,576 | 8/1985 | Tanahashi et al. | 428/35 |
| 4,540,105 | 9/1985 | Wright | 220/359 |
| 4,544,080 | 10/1985 | Wright et al. | 220/359 |
| 4,544,093 | 10/1985 | Stark et al. | 220/359 X |
| 4,555,056 | 11/1985 | Bernhardt | 220/306 X |
| 4,556,152 | 12/1985 | Bogren | 220/276 |
| 4,586,624 | 5/1986 | Shaw | 220/359 X |
| 4,589,568 | 5/1986 | Ito et al. | 220/359 |
| 4,626,157 | 12/1986 | Franek et al. | 413/1 |
| 4,637,543 | 1/1987 | Kucherer | 220/359 X |
| 4,689,099 | 8/1987 | Ito et al. | 156/69 |
| 4,693,390 | 9/1987 | Hekal | 220/359 |
| 4,693,391 | 9/1987 | Roth | 220/359 |
| 4,735,335 | 4/1988 | Torterotot | 220/270 |
| 4,801,041 | 1/1989 | Takata et al. | 220/359 |
| 4,810,541 | 3/1989 | Newman et al. | 428/36.7 |
| 4,858,780 | 8/1989 | Odaka et al. | 220/359 |
| 4,865,217 | 9/1989 | Yoshimoto | 220/359 |
| 4,889,731 | 12/1989 | Williams, Jr. | 426/106 |
| 4,890,759 | 1/1990 | Scanga et al. | 220/273 |
| 4,905,838 | 3/1990 | Suzuki et al. | 206/631 |
| 4,913,307 | 4/1990 | Takata et al. | 220/276 |
| 4,961,513 | 10/1990 | Gossedge et al. | 220/276 |

EASY-OPENING COMPOSITE CLOSURE FOR HERMETIC SEALING OF A PACKAGING CONTAINER BY DOUBLE SEAMING

FIELD OF THE INVENTION

This invention relates to an easy-opening closure for hermetic sealing of the open end of a packaging container. The closure can be formed on conventional end making equipment from composite sheet material and can be joined to the open end of a packaging container using conventional double-seaming equipment.

BACKGROUND OF THE INVENTION

Present commercial operations for hermetically sealing open-ended packaging containers, especially food containers, generally employ either (1) a conventional metallic end, with or without an easy-opening feature, which is double-seamed to a flange on the container, or (2) a film or foil lidding structure, which is attached by adhesive, thermal or other bonding means to a flange on the open end of the container.

With the increasing demand for convenience packaging and ready-to-eat food products, a growing need exists for shelf-stable microwavable food packages. A significant number of these are semi-rigid plastic packaging containers. Food packages for these applications are generally required to undergo a retort/sterilization process to insure that the product is sterile and safe for consumption. Because of the high temperatures and internal pressures associated with the retort process, it is an extremely critical part of the packaging operation to provide a packaging container and closure therefor which have great strength and integrity.

Conventional double-seamed metal ends or closures employed to seal these containers provide seal integrity throughout the retort process, and can provide a convenient easy-open feature for the consumer. The metal end, however, is not entirely appropriate for a package designed to be reheated in a microwave oven, due to arcing and localized heating which can occur during heating. The metal end is also generally not suitable for very wide containers, such as bowls or trays, for a variety of reasons, including the high cost of such an end, and the aesthetically negative appearance of such a package. Additionally, the metal end cannot be used at all in those instances where the heating method of retort comes from microwave energy, due to the very large metallic surface area which would reflect energy and defeat the ability of the microwave energy to heat the package contents. Ready-to-eat packages which employ a metal end often have a sharp metal edge exposed after removal of the easy-open lid, which presents a possible consumer safety hazard.

Film or foil lidding systems as applied to retortable packages are the most sensitive materials used in thermal processing. The adhesive or heat-sealed bond between the body of the packaging container and the lidding material is very fragile during the heat processing period. The bond strength can be reduced by as much as 80% at elevated temperatures. Pressures inside the sealed container can rise dramatically during heating, caused by expansion of the product and gases, which place further demands on the sealing area. An additional challenge to the processor is that many of the film/foil lidding systems are designed to have peelable seals to allow for easy opening. An improved type of flexible lidding systems is disclosed, for example, in U.S. Pat. Nos. 4,801,041; 4,858,780; 4,905,838 and 4,913,307, assigned to Idemitsu Petrochemical Co., Ltd. and commercialized as "MAGICTOP" and which overcomes some of the problems with prior flexible lidding systems. However, all of these flexible lidding systems are attached by bonding to the open end of the container and most processors who employ these types of flexible lidding system must perform extensive testing of seal integrity, including 100% inspection, and require very tight controls on retort conditions to insure against seal failure and/or spoilage of contents.

OBJECT AND SUMMARY OF THE INVENTION

Accordingly, it is the object of this invention to provide an easy-opening closure for hermetic sealing of the open end of a packaging container and which overcomes the above discussed problems heretofore encountered with conventional double-seamed metal ends and with conventional film or foil lidding systems attached by bonding to the open end of the container and which provides a sealed container having seal integrity to allow a retort/sterilization process and reheating by microwave energy.

It has been found by this invention that the above object may be accomplished by providing an easy-opening closure for hermetic sealing of the open end of a packaging container which comprises generally the following.

A composite end of desired construction for being double-seamed to the open end of a packaging container is provided which has an interior ledge portion defining a large central opening to allow access therethrough to the interior of the container. This composite end member includes a multilayer structure having at least two polymer layers which define a predetermined peel strength at an interfacial plane thereof for controlled delamination of the two layers, and a formable substrate layer bonded to the bottom one of the polymer layers and adapting the composite end member to be double-seamed to the container. The composite end member has a continuous notch cut into the top one of the polymer layers in the ledge portion thereof and which is spaced from and surrounds the central opening.

A lidding member of desired configuration covers the central opening in the composite end member and has a portion overlapping the ledge portion thereof and is bonded to the top polymer layer to define a predetermined bond strength greater than the peel strength of the two polymer layers of the composite end member. With this construction, the force required to open the closure from the inside of the container when the closure is double-seamed to the container is greater than the force required to open the closure from the outside of the container since the closure is easily opened by upwardly pulling of the bonded overlapping portion of the lidding member to cause delamination and peeling of the portion of the top polymer layer bonded to the lidding member from the bottom polymer layer beginning at the notch and continuing to the central opening.

The bonding between the lidding member and the top polymer layer of the composite end member is preferably offset a predetermined dimension from the inner edge of the ledge portion defining the central opening and preferably comprises heat sealing. The lidding member preferably includes a tab extending therefrom and being unbonded to the end member for easy grasping to open the closure. The multi polymer layers are preferable adhesively bonded to the substrate layer in the composite end member. The substrate layer of the composite end member preferably comprises either a formable polymeric material or a formable metallic material for adapting the end member to be double-seamed to the packaging container.

The ledge portion of the end member usually extends diametrically inwardly and perpendicularly to the outside wall of the container when the closure is double-seamed to the container to receive and allow bonding of the lidding member thereto. However, if it is desired to have a wider mouth or opening into the sealed container, the ledge portion of the end member can be positioned generally on top of and extend generally perpendicularly to the outside wall of the container or the ledge portion may extend downwardly and generally parallel to the outside wall of the container when the closure is double-seamed to the container.

Accordingly, this invention provides an easy-opening closure for hermetic sealing of the open end of a packaging container in which the closure can be formed on conventional end making equipment from composite sheet material and can be joined to the open end of a packaging container using conventional double-seaming equipment. The hermetically sealed container with the easy-opening closure of this invention thereon is suitable for high temperature retort or boiling conditions of many food processing packaging lines.

A key advantage of the present invention is that the force required to unintentionally delaminate the composite closure of this invention from the inside of the sealed container, as by way of the high internal pressure of retort sterilization, is significantly higher than the force required to intentionally delaminate the composite closure from the outside of the container by way of the easy-opening feature. Since in the present invention the heat sealing of the lidding member to the composite end member is carried out prior to the application of the closure to the filled packaging container, a significant advantage is achieved because seal integrity can be controlled and monitored more closely and the sealing conditions are less apt to be contaminated by foreign material. This is not the case with prior film or foil lidding systems which are heated sealed or otherwise bonded to a flange of the packaging container for closing the container in close proximity to the filling line operations of the user.

BRIEF DESCRIPTION OF THE DRAWINGS

Some of the objects and advantages of this invention have been described above, other objects and advantages will appear in the detailed description of the invention to follow when taken in conjunction with the accompanying drawings, in which.

DETAILED DESCRIPTION OF PREFERRED EMBODIMENTS OF THE INVENTION

Figure 1:
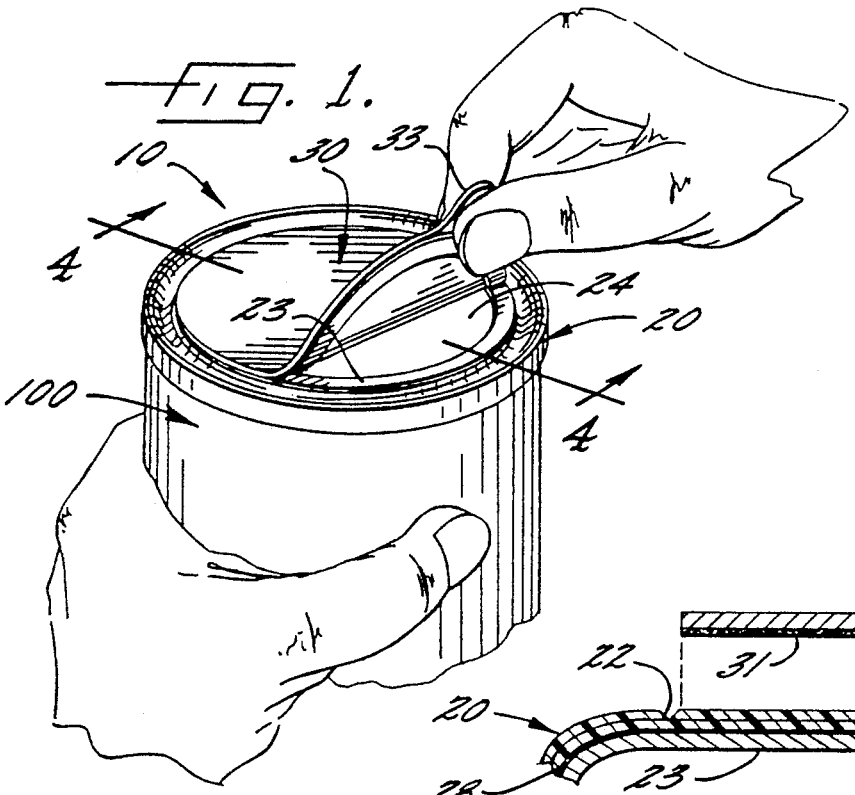
FIG. 1 is a partial perspective view of an easy-opening composite closure constructed in accordance with the present invention and which is double-seamed to one end of a packaging container for hermetic sealing thereof and illustrating the closure being opened.
Figure 3:
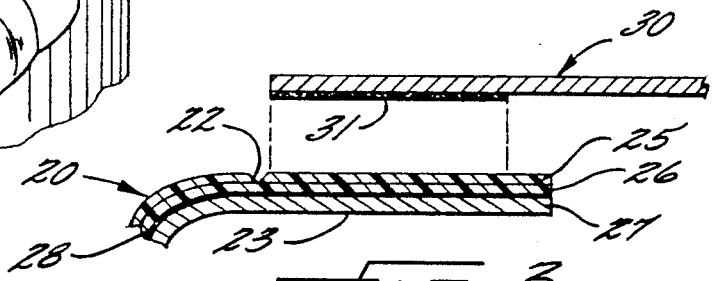
FIG. 3 is an enlarged exploded partial sectional view taken generally within the circle 3 of FIG. 2.
Figure 2:
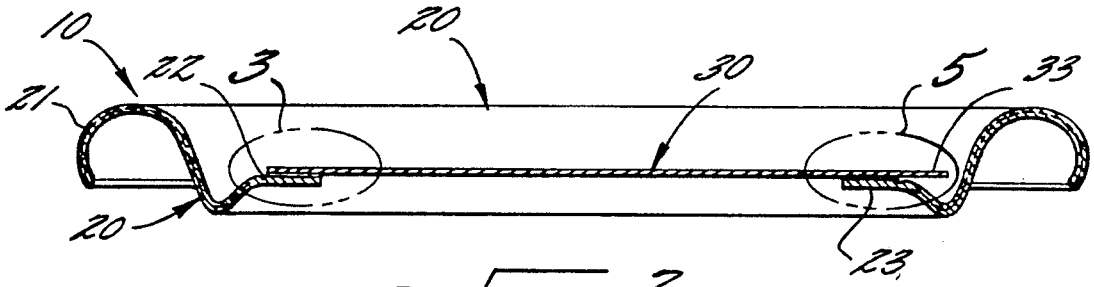
FIG. 2 is a sectional view through an easy-opening composite closure of the type illustrated in FIG. 1 and prior to being double-seamed to the end of a packaging container.

Referring now the drawings, there is illustrated in FIG. 1 an easy-opening closure, generally designated at 10, constructed in accordance with this invention and Which has been double-seamed to the open end of a packaging container, generally designated at 100, for hermetic sealing thereof. The packaging container 100 may be any suitable container for food or other products and may be constructed of semi-rigid plastic, steel, aluminum, or other types of materials used conventionally and designed for the double-seaming thereto of closures of the type described. The packaging container 100 is usually generally cylindrical, but may be in the shape of a bowl, tray, etc. The bottom end (not shown) of the packaging container 100 would be sealed by any conventional closure.

Figure 4:
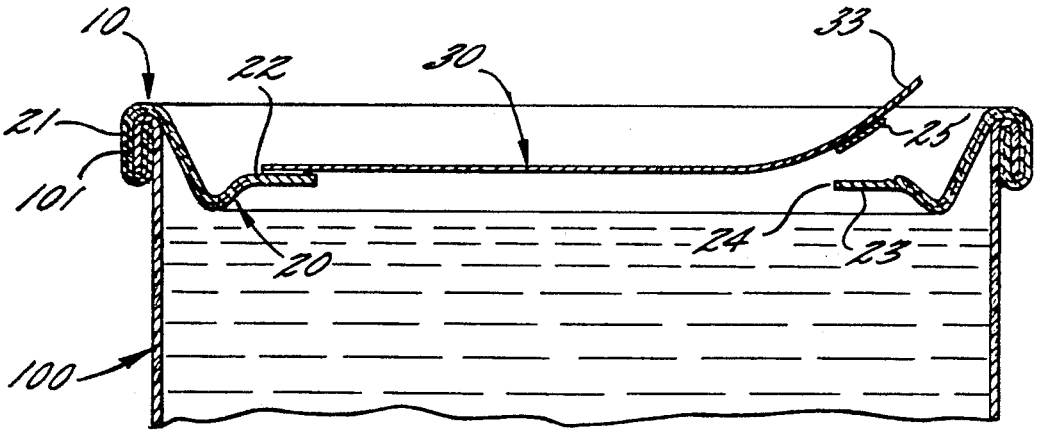
FIG. 4 is an enlarged partial sectional view taken generally along the line 4—4 of FIG. 1.

The easy-opening closure 10 includes a composite end member 20 of desired construction for being double-seamed in a conventional manner on conventional equipment to the open end of the container 100. Conventional double-seaming equipment utilizes a two-step rolling operation to form the end curl 21 of the end member 20 and the body flange 101 of the container 100 into a hermetic double seam, as shown in FIG. 4. The composite end member 20 includes an interior ledge portion 23 which defines a large central opening 24, preferably generally circular to allow access therethrough to the interior of the container The composite end member 20 includes a multilayer structure having at least two polymer layers 25, 26 defining a predetermined peel strength at an interfacial plane for controlled delamination of the two layers 25, 26. Only two such polymer layers 25, 26 are illustrated in the drawings, however, additional layers may be utilized to provide barrier properties, high temperature protection, etc. It is preferred that the top most polymer layer 25 be of a type suitable for heat-seal bonding. Polymers suitable for use as these layers 25, 26 in the composite end member 20 include polyethylene, polypropylene, polyethylene/polypropylene blend, random copolymer polypropylene and high density polyethylene.

The composite end member 20 further includes a formable substrate layer 27 bonded, preferably by a layer of adhesive 28, to the bottom one of the polymer layers 26 to adapt the composite end member 20 to be double-seamed to the container. The composite end member has a continuous notch 22 cut into the top polymer layer 25 in the ledge portion 23 and is spaced from and surrounds the central opening 24. The notch 22 preferably penetrates the polymer layer 25 completely, but does not completely penetrate the polymer layer 26.

This formable substrate layer 27 could be a formable metal substrate of suitable materials, such as aluminum or steel foil, and could have thicknesses ranging from 0.0015" to 0.003" for aluminum and from 0.0005" to 0.0025" for steel. These metal foils are readily commercially available. The adhesive layer 28 could be eliminated and the substrate layer 27 could be bonded to the bottom polymer layer 26 by heat bonding or the like.

The formable substrate layer 27 may also preferably utilize a formable polymeric material suitable for bonding to the multilayer polymer structure 25, 26 and demonstrating the ability to be cold-formed, thus making it suitable for use in existing end making equipment and double-seaming equipment. This polymeric substrate material would be less expensive than the metallic substrate and would provide an all plastic end member 20 which is more suitable in microwave retort and reheating applications. Those plastic materials which have the necessary characteristics of ductility, high tensile strength, high flexural modulus, etc. to exhibit good performance as a formable substrate include acrylonitrile butadiene styrene (ABS), polyvinyl chloride (PVC), polycarbonate (PC) and other plastic compounds, alloys or blends having such characteristics.

The easy-opening closure 10 further includes a lidding member 30 of desired configuration, preferably circular, covering the central opening 24 and having a portion overlapping the ledge portion 23 and bonded thereto, preferably by heat sealing 31, to the top polymer layer 25 of the composite end member 20 to define a predetermined bond strength which is greater than the peel strength of the two polymer layers 25, 26 of the composite end member 20. It has been found that a bond strength between the lidding member 30 and the top polymer layer 25 by the heat seal bond 31 could be in the range of 3 lbs. to 8 lbs. and the peel strength for controlled delamination of the polymer layers 25, 26 could be in the range of 1.5 lbs. to 4.5 lbs. The lidding member 30 may be formed from a wide variety of materials, depending on the requirements of the specific application. These could include flexible thin films, semi-rigid or rigid sheet, composite structures incorporating metal and/or paper foils, high-barrier multilayer structures, transparent films, and others. The lidding member 30 must be capable of being heat-sealed, or bonded by other means, to the end member.

Figure 5:
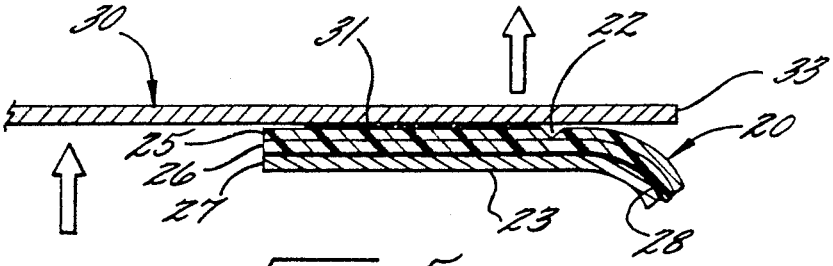
FIG. 5 is an enlarged partial sectional view taken generally within the circle 5 of FIG. 2.
Figure 6:
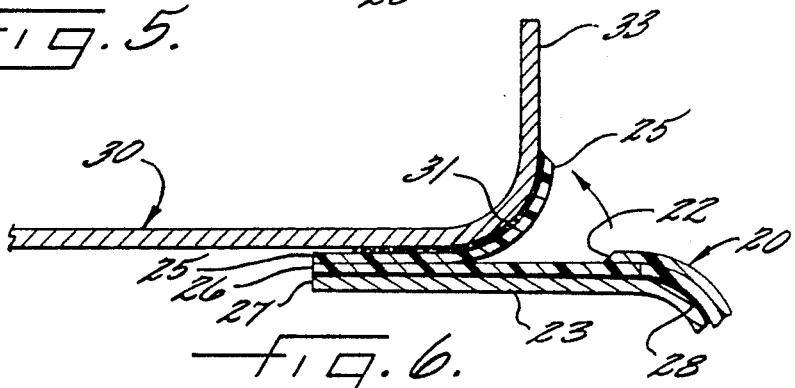
FIG. 6 is a view like FIG. 5 showing the composite closure as it is being easy-opened.

The heat seal bond 31 between the lidding member 30 and the top polymer layer 25 in the ledqe portion 23 of the composite end member 20 thermally fuses the lidding member 30 to the end member 20 continuously around the periphery of the central opening 24. This heat seal bond 30 is preferably about 2 mm to 3 mm or larger in width and is preferably offset a minimum of lmm from the inner edge of the ledge portion 23 (as clearly shown in FIGS. 5 and 6. This offset aides the preferred performance of the easy-opening closure of this invention during retort or other high temperature processing by distributing stresses associated with high internal pressure over a wide area of the heat seal 31. By contrast, if there were no heat-seal offset and the heat-seal was brought out to the edge of the ledge portion 23 defining the central opening 24, internal pressures produced during retort or high temperature processing would create high stresses between the polymer layers 25, 26 and would tend to promote unintentional delamination.

The lidding member 30 preferably includes a tab 33 extending therefrom on one side thereof and being unbonded to the end member 10 for easy grasping (as shown in FIG. 1) to open the closure 10.

The thus formed easy-opening closure 10 would be double-seamed onto the open end of the filled packaging container 100 by a double-seaming operation, as described above. The contents within the packaging container 100 are thus hermetically sealed and protected from exposure to any contamination from outside air or organisms. The seal may be enhanced by the optional addition of a barrier polymer layer added to either or both the composite end member 20 or the lidding member 30. Easy opening of the closure 10 is effected by taking advantage of the controlled delamination of the polymer layers 25, 26 of the end member 20, instead of using the heat seal bond 31 of the lidding member 30 as a peeling area.

Opening is accomplished by grasping the tab 33 and applying an upward force thereto. As this force is applied, the notch 22 acts as a stress concentrator which promotes the fracture and subsequent delamination The delamination (as partially shown in FIGS. 1 and 6) continues from the notch 22 through the ledge portion 23 and to the inner edge thereof which defines the central opening 24 and, thus, allows complete removal of the lidding member 30. Because the heat seal bond 31 is not used as the peelable interface, it can be fused much more completely than would be possible otherwise. As such, the heat seal bond 31 has much greater bond strength than does the peel strength for delamination of the two polymer layers 25, 26 of the end member 20. Generally, with the above defined peel strength for controlled delamination of the polymer layers 25, 26, it has been found that a force of approximately 2 to 4 pounds will begin controlled delamination of the polymer layers 25, 26 at the notch 22 to easy-open the closure 10.

Figure 7:
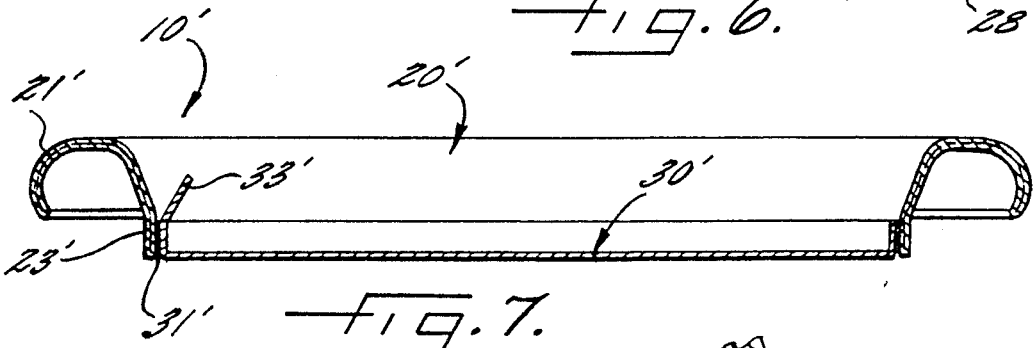
FIG. 7 is a sectional view through a modified construction of an easy-opening composite closure in accordance with this invention.
Figure 8:
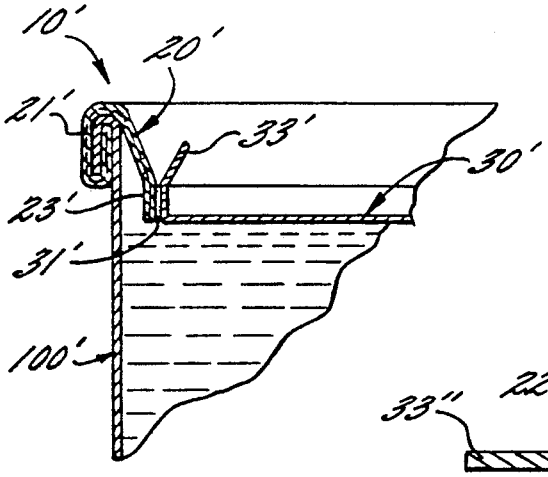
FIG. 8 is a partial sectional view illustrating the composite closure of FIG. 7 double-seamed to a packaging container.
Figure 9:
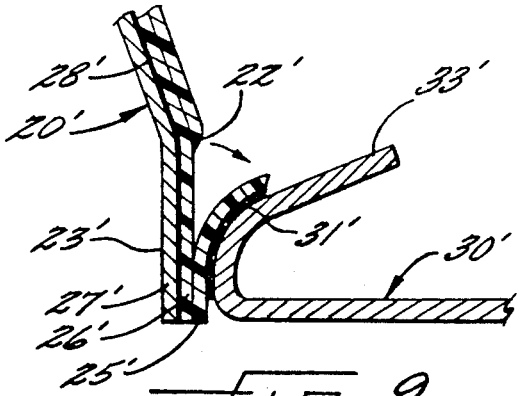
FIG. 9 is an enlarged partial sectional view illustrating the composite closure of FIGS. 7 and 8 being easy-opened.

As may be seen in FIGS. 1-6, the ledge portion 23 of the composite end member 20 of the closure 10 extends diametrically inwardly and perpendicularly to the outside wall of the packaging container 100 when the closure 10 is double-seamed to the container 100. This would be the usual orientation of the ledge portion 23 for receipt of the lidding member 30 and heat seal bonding of the lidding member 30 to the end member 20. This arrangement would provide the type of central opening 24 shown in FIG. 1 when the lidding member 30 is removed from the end member 20 of the closure 10. However, if a larger central opening is desired for the same diameter packaging container, a modified or alternative form of closure may be utilized, as indicated at 10 in FIGS. 7-9. All reference numerals utilized for this embodiment of FIGS. 7-9 which are the same as those of the above described embodiment of FIGS. 1-6, are utilized with prime notations. In this embodiment, the ledge portion 23' of the end member 20' extends downwardly and generally parallel to the outside wall of the container 100' when the closure 10: is double-seamed thereto. The lidding member 30' would include a rim portion extending generally perpendicular to the remainder of the lidding member to be bonded by a heat seal 31' to the ledge portion 23' of the end member 20' Otherwise, the construction and operation, including easy-opening, of this embodiment operates in the manner discussed above.

Figure 10:
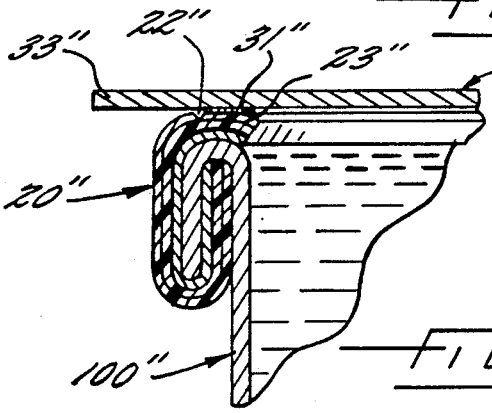
FIG. 10 is a partial sectional view, like FIG. 8, enlarged and illustrating a further modified construction of easy-opening composite closure in accordance with this invention double-seamed to the end of a packaging container.

A further alternative or modified construction for a wide central opening in an easy-opening closure in accordance with this invention is illustrated in FIG. 10 and indicated by double prime notations for all of the reference characters corresponding to above described embodiments of this invention. In this embodiment, the ledge portion 23" of the end member 20" is positioned generally at the top of and extends generally perpendicularly to the outside wall of the container 100 when the closure 10" is double-seamed to the container 100". Otherwise, the construction and easy-opening operation of this embodiment of closure 10" is the same as that described above.

Thus, this invention has provided an easy-opening closure for hermetic sealing of the open end of a packaging container and which overcomes problems heretofore encountered with conventional double-seamed metal ends and with conventional film or foil lidding systems. Use of the easy-opening closure of this invention on a packaging container provides seal integrity to allow retort/sterilization processes and reheating by microwave energy.

Although specific and descriptive terms have been utilized in the above description of the preferred embodiments of this invention, these terms and descriptions are used in a generic and descriptive sense only and are not for purposes of limitation. The scope of the invention is defined in the following claims.

What is claimed is:

1. An easy-opening closure for hermetic sealing of the open end of a packaging container and comprising:

a composite end member of desired construction for being double-seamed to the open end of the container and having an interior ledge portion defining a large central opening to allow access therethrough to the interior of the container, said composite end member including at least two polymer layers defining a predetermined peel strength at an interfacial plane thereof for controlled delamination of said two layers and a formable substrate layer bonded to the bottom one of said polymer layers and adapting said composite end member to be double-seamed to the container, said composite end member having a notch cut into the top one of said polymer layers in said ledge portion and spaced from and surrounding said central opening; and a lidding member of desired configuration covering said central opening and having a portion overlapping said ledge portion and bonded to said top polymer layer in said composite end member to define a predetermined bond strength greater than said peel strength of said two polymer layers of said composite end member;

whereby, the force required to open said closure from the inside of the container when double-seamed to the container is greater than the force required to open said closure from the outside of the container since said closure is easily-opened by upwardly pulling of said bonded overlapping portion of said lidding member to cause delamination and peeling of the portion of said top polymer layer bonded to said lidding member from said bottom polymer layer beginning at said notch and continuing to said central opening.

2. An easy-opening closure, as set forth in claim 1, wherein the bonding between said lidding member and said top polymer layer of said composite end member is offset a predetermined dimension from the inner edge of said ledge portion defining said central opening.

3. An easy-opening closure, as set forth in claim 1 or 2, wherein said lidding member further includes a tab extending therefrom and being unbonded to said end member for easy grasping to open said closure.

4. An easy-opening closure, as set forth in claim 1 or 2, wherein the bonding between said lidding member and said top polymer layer of said composite end member comprises heat sealing.

5. An easy-opening closure, as set forth in claim 1 or 2, wherein said composite end member further includes an adhesive layer for bonding said substrate layer to said polymer layers.

6. An easy-opening closure for hermetic sealing of the open end of a packaging container and comprising:

a composite end member of desired construction for being double-seamed to the open end of a generally cylindrical container and having an interior ledge portion defining a large generally circular central opening to allow access therethrough to the interior of the container, said composite end member including at least two polymer layers defining a predetermined peel strength at an interfacial plane thereof for controlled delamination of said two layers and a formable substrate layer adhesively bonded to the bottom one of said polymer layers and adapting said composite end to be double-seamed to the container, said composite end member having a continuous notch cut into the top one of said polymer layers in said ledge portion and spaced from and surrounding said central opening; and a lidding member of generally circular configuration covering said central opening and having a portion overlapping said ledge portion and bonded by heat sealing to said top polymer layer in said composite end member to define a predetermined bond strength greater than said peel strength of said two polymer layers of said composite end member and having a tab extending therefrom and being unbonded to said end member for easily grasping to open said closure, the bonding between said lidding member and said top polymer layer of said composite end member being off set a predetermined dimension from the inner edge of said ledge portion defining said central opening;

whereby, the force required to open said closure from the inside of the container when double-seamed to the container is greater than the force required to open said closure from the outside of the container since said closure is easily-opened by upward pulling of said tab and said bonded overlapping portion of said lidding member to cause delamination and peeling of the portion of said top polymer layer bonded to said lidding member from said bottom polymer layer beginning at said notch and continuing to said central opening.

7. An easy-opening closure, as set forth in claim 1 or 6, wherein said substrate layer of said composite end member comprises a formable polymeric material.

8. An easy-opening closure, as set forth in claim 1 or 6, wherein said substrate layer of said composite end member comprises a formable metallic material.

9. An easy-opening closure, as set forth in claim 1 or 6, in which said ledge portion of said end member extends diametrically inwardly and perpendicularly to the outside wall of the container when said closure is double-seamed to the container.

10. An easy-opening closure, as set forth in claim 1 or 6, in which said ledge portion of said end member is positioned generally on top of and extends generally perpendicularly to the outside wall of the container when said closure is double-seamed to the container.

11. An easy-opening closure, as set forth in claim 1 or 6, in which said ledge portion of said end member extends downwardly and generally parallel to the outside wall of the container when said closure is double-seamed to the container.

* * * * *

UNITED STATES PATENT AND TRADEMARK OFFICE

CERTIFICATE OF CORRECTION

PATENT NO. : 5,069,355

DATED : December 3, 1991

INVENTOR(S) : John J. Matuszak

It is certified that error appears in the above-identified patent and that said Letters Patent is hereby corrected as shown below:

Column 4, line 25, "Which" should be -- which --.

Column 5, line 57, "30" should be -- 31 --.

Column 5, line 59, "1mm" should be -- 1 mm --.

Column 6, line 26, after "delamination" insert -- of the two polymer layers 25, 26, of the end member 20 --.

Column 6, line 38, "2" and "4" should not be in bold print.

Column 6, line 57, "10" should be -- 10′ --.

Column 6, line 63, "10:" should be -- 10′ --.

Column 7, line 11, "100" should be -- 100′′ --.

Signed and Sealed this

Eleventh Day of May, 1993

*Attest:*

Michael K. Kirk

MICHAEL K. KIRK

*Attesting Officer*

*Acting Commissioner of Patents and Trademarks*